US005368231A

United States Patent [19]

Brunerie et al.

[11] Patent Number: 5,368,231

[45] Date of Patent: Nov. 29, 1994

[54] DISPENSER FOR FOAM UNDER PRESSURE

[75] Inventors: Patrice Brunerie, Tremblay-en-France; Vincent De Laforcade, Rambouillet, both of France

[73] Assignee: L'Oreal, Paris, France

[21] Appl. No.: 205,306

[22] Filed: Mar. 3, 1994

[30] Foreign Application Priority Data

Mar. 5, 1993 [FR] France ..... 93 02575

[51] Int. Cl.[5] ..... B05B 7/26

[52] U.S. Cl. ..... 239/145; 239/343; 239/372; 222/190; 222/402.18

[58] Field of Search ..... 239/145, 343, 354, 370, 239/372, 432, 573; 222/190, 402.18

[56] References Cited

U.S. PATENT DOCUMENTS

| | | | |
|---|---|---|---|
| 3,653,553 | 4/1972 | Prussin et al. | 239/372 X |
| 4,156,505 | 5/1979 | Bennett | 239/343 X |
| 4,509,661 | 4/1985 | Sugizaki et al. | 222/190 |
| 4,720,046 | 1/1988 | Morane | 239/343 |
| 4,796,812 | 1/1989 | Grollier | 239/343 X |
| 4,921,170 | 5/1990 | Grollier | 239/343 X |
| 4,932,567 | 6/1990 | Tanabe et al. | 239/343 X |

FOREIGN PATENT DOCUMENTS

| | | | |
|---|---|---|---|
| 2361933 | 3/1978 | France . | |
| 2380075 | 10/1978 | France | 239/372 |
| 2672038 | 7/1992 | France . | |
| 2615668 | 10/1976 | Germany . | |
| 1543966 | 4/1979 | United Kingdom . | |
| 1572818 | 8/1980 | United Kingdom . | |
| 2184789 | 7/1987 | United Kingdom . | |
| 2188257 | 9/1987 | United Kingdom | 222/190 |

*Primary Examiner*—William Grant
*Attorney, Agent, or Firm*—Young & Thompson

[57] ABSTRACT

Dispenser for foam under pressure, containing a foaming liquid pressurized by a non-liquefied compressed gas, equipped with a dispensing valve (7) having additional gas take-off (8), such that the gas/liquid ratio of the mixture dispensed lies between 95/5 and 99/1 (vol/vol), the dispenser being fitted with a pushbutton (30) which includes a spraying member and an endpiece, the end-piece comprising a case (34) defining an accumulation chamber (40) into which the spraying member sprays the product to be dispensed through a spray nozzle (39) emerging into the accumulation chamber (40), the nozzle (39) having a diameter lying between 0.7 and 2 mm, the chamber (40) being closed by a porous frit (36) constituting, at least in part, a wall of the accumulation chamber (40) opposite that in which the spray nozzle (39) is arranged and located at a distance from the latter lying between 0.5 and 5 mm.

9 Claims, 1 Drawing Sheet

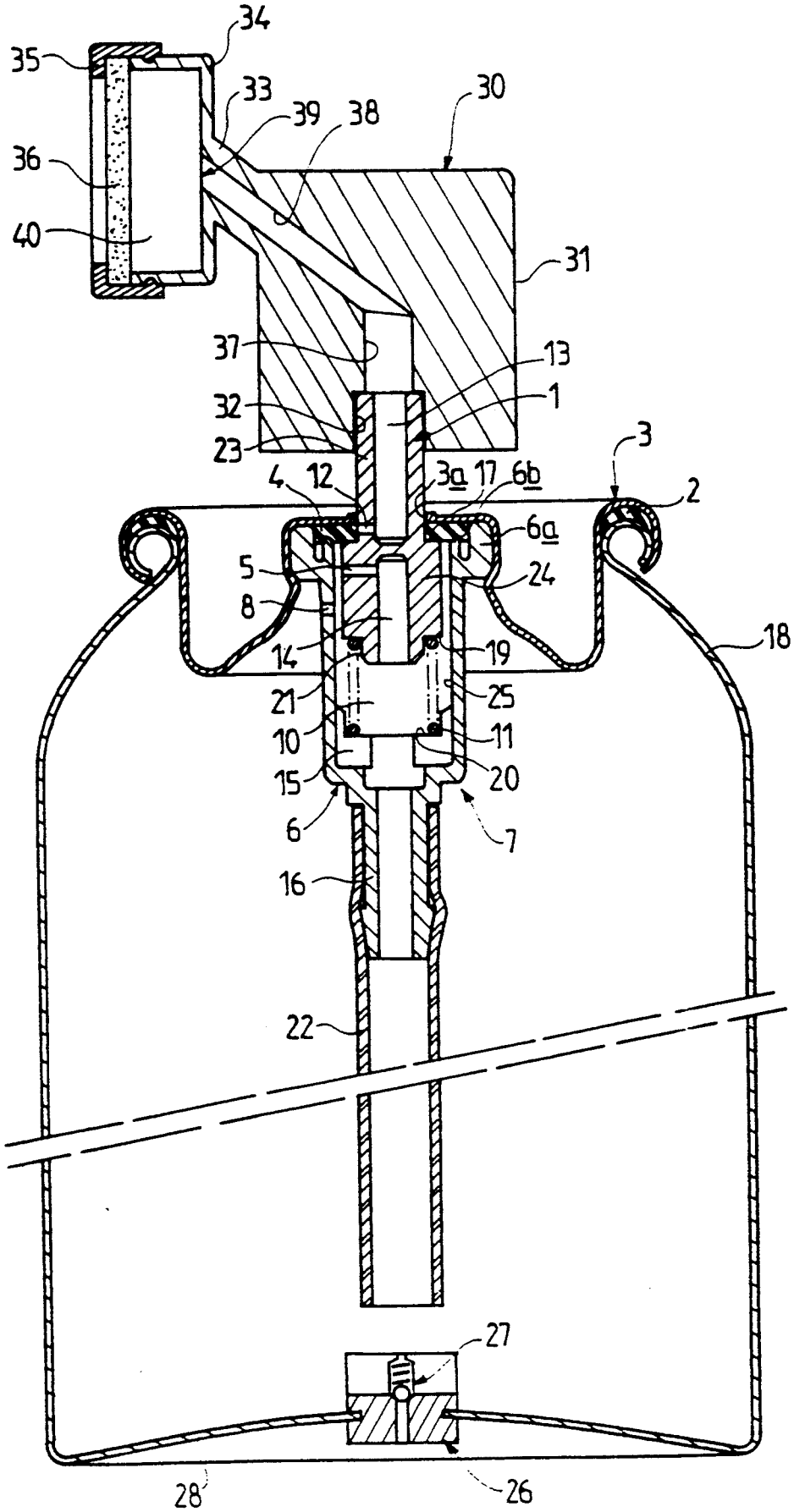
34
35
33
39
38
30
36
40
31
37
13
32
1
23
3
4
12
3a
17
6b
2
6a
5
24
8
18
14
19
21
25
10
11
15
20
6
7
16
22
27
28
26

DISPENSER FOR FOAM UNDER PRESSURE

The subject of the present invention is a dispenser for converting a spray into foam.

An element has already been proposed which is intended to be used with a liquid dispenser which gives the product to be dispensed the form of a foam rather than that of a spray or of a mist; this is the case, for example, of the foam dispenser described in FR-A-2,361,933. The element described in this document provides, for the production of the foam, for the use of air in various ways which depend in particular on the quantity of air already present in the liquid product coming from the dispenser; thus, the element has to be adapted to the dispenser, and especially may or may not have vents permitting the introduction of external air into a chamber called the aeration chamber.

The applicant has found that by endowing the dispenser with an end-piece in order to convert a spray into foam with dimensional characteristics such as described hereinbelow, the said dispenser is suitable for supplying the foam in good condition.

Thus, according to the invention, a dispenser for foam under pressure, containing a foaming liquid pressurized by a non-liquefied compressed gas, equipped with a dispensing valve having additional gas take-off such that the gas/liquid ratio of the mixture dispensed lies between 95/5 and 99/1 (vol/vol), is fitted with a push-button which includes a spraying member and an endpiece, the said end-piece comprising a case defining an accumulation chamber into which the spraying member sprays the product to be dispensed through a spraying nozzle emerging into the said accumulation chamber, the said nozzle having a diameter lying between 0.7 and 2 mm, the said chamber being closed by a porous frit constituting, at least in part, a wall of the said accumulation chamber opposite that in which the spray nozzle is arranged and located at a distance from the latter lying between 0.5 and 5 mm.

Advantageously, the frit has a thickness lying between 0.5 and 4 mm, preferably 0.75 mm; the size of the pores of the frit lies between 10 and 50 microns, preferably between 15 and 25 microns and more particularly of the order of 20 microns.

Preferably, the spray is produced under an absolute pressure lying between 1.5 and 6 bar, preferably between 3.5 and 6 bar.

The non-liquefied compressed gas is, especially, air or nitrogen.

Advantageously, the pressure is produced by the compressed air under pressure constituting the propellent gas for the product to be dispensed in the form of foam.

In order to understand the subject of the invention better, a description will now be made, by way of purely illustrative and non-limiting example, of an embodiment shown, in the appended drawing, in partial section.

According to this drawing, a dispenser consists of a container 18 having a bottom 28 and is closed in its upper part by a metal sealing cup 3, a seal 2 providing the sealing of the closure. The container 18 is filled with a liquid to be sprayed and with a gas under pressure, for example compressed air. A dispensing valve 7 comprises a valve body 6 and an operating rod 1; the valve body 6, of cylindrical general shape, has, at its upper part, a rim 6*a* of larger diameter than the rest of the body and allowing the body 6 to be held by the metal sealing cup 3 by crimping. The transverse upper wall of the sealing cup 3 is pierced with a circular orifice 3*a*; an annular seal 4, placed inside the rim 6*a*, is compressed, during the crimping, between the upper wall of the sealing cup 3 and an annular bearing surface 6*b*, concentric with the rim 6*a* and carried by the valve body 6, prolonging the cylindrical internal wall 25 of the body 6 as far as the seal 4; the operating rod 1 comprises two coaxial cylindrical portions 23 and 24 defining a transverse annular bearing surface 17; the portion 23 of the rod 1 has a diameter slightly less than that of the orifice 3*a* of the sealing cup 3, whereas the portion 24 of the rod 1 has a diameter greater than that of the orifice 3*a*, while still being slightly less than the diameter of the internal wall 25 of the body 6. When the operating rod 1 is mounted on the body 6, the portion 23 passes through the seal 4 and the orifice 3*a* of the upper wall of the sealing cup 3, and the portion 24 is in the chamber 10 defined inside the body 6; the body 6 has, in its lower part, a prolongation 16, of smaller diameter than that of the rest of the body, along the axis of the body 6, and shaped into an end-piece to which a plunger tube 22 made of plastic is connected, allowing communication between the chamber 10 and the product to be sprayed, contained in the container 18, the plunger tube 22 going down as far as the vicinity of the bottom 28 of the said container. Inside the body 6, in the vicinity of the bottom of the chamber 10, radial fins 15, distributed circumferentially, define a planer transverse stop surface 20, serving as a seat for a helical spring 11; the cylindrical portion 24 of the rod 1 is prolonged, in its lower part, by a tail-piece 21 of smaller diameter so that a transverse bearing surface 19 is defined at the connection of the tail-piece 21 with the portion 24; the spring 11, at its other end, surrounds the tail-piece 21 and bears on the bearing surface 19, thus applying, at rest, the transverse annular bearing surface 17 of the rod 1 against the annular seal 4.

A small orifice 8 is arranged in the wall of the body 6 and makes the chamber 10 communicate with the upper volume of the container 18 in which is the gas under pressure.

The second cylindrical portion 24 of the rod 1 has an axial blind passage 14 followed by a radial passage 5 passing through the wall of the said second portion 24, the said axial 14 and radial 5 passages emerging respectively into the chamber 10. A blind axial channel 13 is also arranged in the first portion 23 of the rod 1; the channel 13 is, moreover, in communication with the outside of the rod 1 via a radial channel 12 passing through the wall of the first portion 23 of the rod 1; the cross-section of the said channel 12 via which it emerges into the outside is less than the thickness of the seal 4; in the rest position, as shown in the drawing, the channel 12 emerges right opposite the thickness of the seal 4.

The dispenser comprises a push-button 30; the push-button 30 comprises a cylindrical body 31 of circular cross-section having, in its lower part, a housing 32 allowing fitting of the portion 23 of the rod 1 in order to place the push-button 30 on the container 18. The body 31 carries a neck 33; according to one exemplary embodiment, the neck 33 is inclined with respect to the longitudinal axis of the body 31. Channels 37 and 38 pass through the body 31 and the neck 33, in the prolongation of each other, the channel 37 emerging into the housing 32 and the channel 38 terminating in a spray nozzle 39.

According to the invention, the dispenser operates as follows. Starting from the rest position, such as shown in the figure, a downward action on the push-button 30, and therefore on the operating rod 1, makes the latter descend into the body 6; the radial channel 12 is no longer obstructed by the seal 4. Thus, the liquid to be sprayed is pushed by the gas under pressure from the plunger tube 22 towards the chamber 10 and the channels 14, 5, 12, 13, and towards the spray nozzle 39; at the same time, since the small orifice 8 makes the upper part of the container containing the gas under pressure communicate with the chamber 10, gas under pressure is also brought to join the nozzle via the upper part of the chamber 10 and the channels 12 and 13; in fact, it is a mixture of propellent gas and liquid product which is sprayed through the spray nozzle 39; the loss of head through the additional gas take-off which the small orifice 8 constitutes results in a pressure in the chamber 10 less than the pressure in the container 18, which allows dispensing of the product, from the container, as described hereinabove.

When the action on the operating rod 1 ceases, the spring 11 pushes the rod 1 back into the position where the bearing surface 17 is in contact with the seal 4, and the channel 12 is in line with this seal 4.

According to the invention, the neck 33 supports a case 34 defining an accumulation chamber 40; according to the example shown, the case 34 is cylindrical, having a circular cross-section, along an axis perpendicular to the longitudinal axis of the container 18. The nozzle 39 emerges into the chamber 40 of the case 34 which, on the side opposite the nozzle 39, is closed by a disc 36 made of fritted material held by a support mask 35 clipped onto the case 34. Thus, upon acting on the push-button 30, as described hereinabove, a fine spray of the product is admitted into the case 34, through the nozzle 39, this spray being generated by the spraying member constituted by the valve 7.

Since the nozzle has a diameter lying between 0.7 and 2 mm and the disc 36 being at a distance lying between 0.5 and 5 mm from the nozzle 39, the spray produced by the valve 7 is dispensed in the form of foam at the outlet of the case 34. Excellent results have been obtained with a frit having a thickness lying between 0.5 and 4 mm, preferably 0.75 mm, the size of the pores of the frit being of the order of 20 microns. The dispenser is advantageously pressurized with the compressed air, under a pressure of 1.5 to 6 bar, preferably 3.5 to 6 bar; the cross-section of the orifice 8 is such that the spray produced in the case 34 contains 95 to 99% of air by volume.

As a variant, the air is replaced by another non-liquefied compressed gas, such as nitrogen.

In the example shown, the case 34 and the push-button 30 are made as a single piece; as a variant, the case 34 is attached to the conventionally-provided push-button 30.

The bottom 28 of the container 18 includes a connector 26 fitted with a check valve 27, for example of the ball check valve type, allowing the inflow of the gas under pressure into the container 18 but preventing its outflow. This connector 26 allows connection to a source of gas under pressure, in particular the outlet of a compressor (not shown), which allows the container 18 to be recharged with gas under pressure.

We claim:

1. Dispenser for foam under pressure, containing a foaming liquid pressurized by a non-liquefied compressed gas, equipped with a dispensing valve (7) having an additional gas take-off (8), said additional gas take-off being sized such that the gas/liquid ratio of the mixture dispensed lies between 95/5 and 99/1 (vol/vol), the said dispenser being fitted with a pushbutton (30) which includes a spraying member and an endpiece, the said end-piece comprising a case (34) defining an accumulation chamber (40) into which the spraying member sprays the product to be dispensed through a spray nozzle (39) emerging into the said accumulation chamber (40), the said nozzle (39) having a diameter lying between 0.7 and 2 mm, the said chamber (40) being closed by a porous frit (36) constituting, at least in part, a wall of the said accumulation chamber (40) opposite that in which the spray nozzle (39) is arranged and located at a distance from the latter lying between 0.5 and 5 mm.

2. Dispenser according to claim 1, characterized in that the frit (36) has a thickness lying between 0.5 and 4 mm.

3. Dispenser according to claim 2, characterized in that the size of the pores of the frit (36) lies between 10 and 50 microns.

4. Dispenser according to claim 3, characterized in that the size of the pores of the frit (36) lies between 15 and 25 microns.

5. Dispenser according to claim 4, characterized in that the size of the pores of the frit (36) is of the order of 20 microns.

6. Dispenser according to one of claims 1 to 5, characterized in that the spray is produced under an absolute pressure lying between 1.5 and 6 bar.

7. Dispenser according to claim 6, characterized in that the spray is produced under an absolute pressure lying between 3.5 and 6 bar.

8. Dispenser according to claim 6, characterized in that the pressure is produced by compressed air under pressure constituting the non-liquefied gas for the foaming liquid to be dispensed in the form of foam.

9. Dispenser according to claim 2, wherein the thickness of the frit (36) is about 0.75 mm.

* * * * *